US009488427B1

(12) United States Patent
Lucero

(10) Patent No.: US 9,488,427 B1
(45) Date of Patent: Nov. 8, 2016

(54) FAST ACCESS TRIGGER LOCK

(71) Applicant: Don Scott Lucero, Alexandria, VA (US)

(72) Inventor: Don Scott Lucero, Alexandria, VA (US)

( * ) Notice: Subject to any disclaimer, the term of this patent is extended or adjusted under 35 U.S.C. 154(b) by 0 days.

(21) Appl. No.: 14/980,267

(22) Filed: Dec. 28, 2015

Related U.S. Application Data

(60) Provisional application No. 62/102,502, filed on Jan. 12, 2015.

(51) Int. Cl.
*F41A 17/00* (2006.01)
*F41A 17/06* (2006.01)
*F41A 17/46* (2006.01)

(52) U.S. Cl.
CPC ..... *F41A 17/063* (2013.01); *F41A 17/46* (2013.01)

(58) Field of Classification Search
USPC ..... 42/70.06, 70.07, 70.11
See application file for complete search history.

(56) References Cited

U.S. PATENT DOCUMENTS 5,419,068 A 5/1995 Pages
5,713,149 A 2/1998 Cady
6,237,271 B1 * 5/2001 Kaminski ..... F41A 17/063 42/70.01
6,351,906 B1 * 3/2002 Honig, Jr. ..... F41A 17/063 42/66
6,408,555 B1 6/2002 Sapia
7,155,855 B2 1/2007 Mauch
7,562,480 B2 7/2009 Mauch
7,726,059 B2 6/2010 Pikielny
7,832,135 B1 11/2010 Salvitti
8,046,948 B2 11/2011 Mauch
8,127,482 B2 * 3/2012 O'Shaughnessy .... F41A 17/063 42/70.01
8,418,391 B2 4/2013 Kemmerer
8,677,688 B2 3/2014 Skibinski
8,713,836 B1 5/2014 Haq
8,720,097 B2 5/2014 Derman
2001/0027671 A1 10/2001 Davis
2002/0174587 A1 11/2002 Rumfelt
2008/0134556 A1 * 6/2008 Remelin ..... F41A 17/066 42/70.07
2009/0223104 A1 * 9/2009 Anzeloni ..... F41A 17/063 42/70.06
2012/0291327 A1 11/2012 Boutot
2014/0215881 A1 * 8/2014 Milde, Jr. ..... F41A 35/00 42/70.06

* cited by examiner

*Primary Examiner* — J. Woodrow Eldred

(57) ABSTRACT

This invention relates to an apparatus and method for detecting user activation of a button disposed on a trigger lock, communicating with a token located within a proximity of the trigger lock in response to the detection, receiving a user identifier from the token during the communication, determining whether the received user identifier is valid, and unlocking the trigger lock if the user identifier is determined to be valid. Provided that the token is located within the proximity and is valid, the user is only required to make a single contact with the trigger lock to unlock the trigger lock. Unauthorized access to the trigger of a firearm is thereby prevented while permitting an authorized user to quickly use the firearm.

30 Claims, 8 Drawing Sheets

FAST ACCESS TRIGGER LOCK

This application claims the benefit of U.S. Provisional Application No. 62/102,502 filed Jan. 12, 2015; the entirety of which is incorporated herein by reference.

DETAILED DESCRIPTION OF EMBODIMENTS

Figure 1:
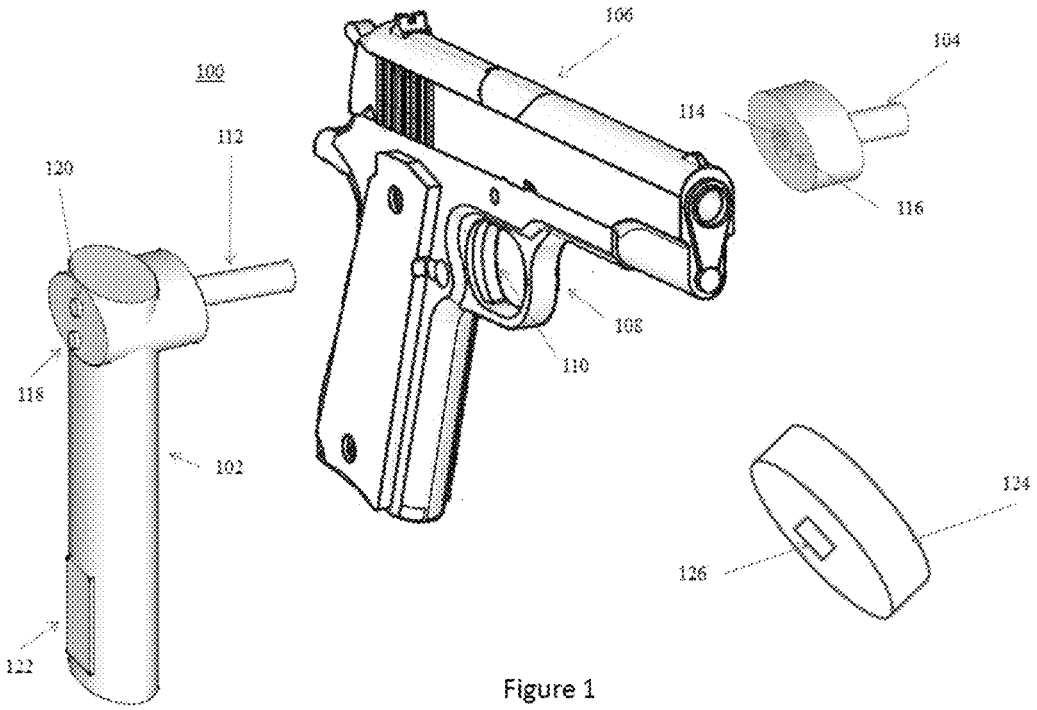
FIG. 1 shows a disassembled trigger lock ready for attachment to a firearm.

An overview of an embodiment of a Rapid Access Trigger Lock System 100 is described with reference to FIG. 1. Rapid Access Trigger Lock System 100 may include a trigger lock comprising a primary section 102 and a secondary section 104. A firearm 106 may be provided with a trigger guard 108 and a trigger 110. Primary section 102 and secondary section 104 may be configured to lock together to sandwich trigger guard 108 thereby preventing access to trigger 110 when the trigger lock is in a locked state. When placing the trigger lock onto a firearm, a locking bolt housing 112 may be guided through trigger guard 108 and inserted into a grooved cavity 114. Primary section 102 and secondary section 104 both may include a rubberized cushion 116 shaped to form a seal around trigger guard 108 when the trigger lock is in a locked state.

The structure of the trigger lock may provide the means for removably securing a trigger lock to a firearm such that the trigger cannot be accessed or the firearm fired while the trigger lock is in the locked state. In the present embodiment, a locking bolt may be used to securely attach primary section 102 to secondary section 104. However, alternative means for removably securing a trigger lock to a firearm are possible in other embodiments. Furthermore, although this embodiment depicts a two-piece trigger lock, alternative single and multi-piece trigger locks are possible in other embodiments. The body of primary section 102 and secondary section 104 may be metallic in some embodiments. Alternatively, other materials providing the requisite strength to provide support and prevent tampering are possible.

Primary section may further comprise a button 118, a user interface 120, and a radio frequency communication interface 122. Rapid Access Trigger Lock System 100 may further include an access key 124 containing a radio-frequency identifier (RFID) 126. In order to unlock a locked trigger lock, a user may position access key 124 within proximity to communication interface 122. While access key 124 is in proximity to communication interface 122, the user may press button 118 and thereby activate a trigger lock interrogation program which may transmit an interrogation signal. Any nearby access keys 124 within proximity range of the interrogation signal may provide a response signal via RFID 126 containing the identifier of access key 124. The trigger lock may receive the identifier and may perform authentication on the identifier. If the identifier is valid, the trigger lock may transition to an unlocked state. In the present embodiment, button 118 may be sized such that the user would only require one finger to press button 118. Therefore, provided that a valid access key 124 is within proximity range of the trigger lock, the trigger lock may be unlocked with only a single point of contact by the user.

Rapid Access Trigger Lock System 100 may provide rapid access to a secured firearm in the case of an emergency without requiring the user to perform a complex procedure under stress. In the present embodiment, access key 124 is depicted as a bracelet. Access keys 124 may be a wearable article such as a bracelet or a watch; however, access key 124 may be any article that contains RFID 126. In alternative embodiments, access key 124 may take the form of a ring as will be discussed in further detail below. By providing RFID 126 within an article worn by the user, the user may be relieved of the burden of trying to find the article to carry to the trigger lock during an emergency.

Figure 2:
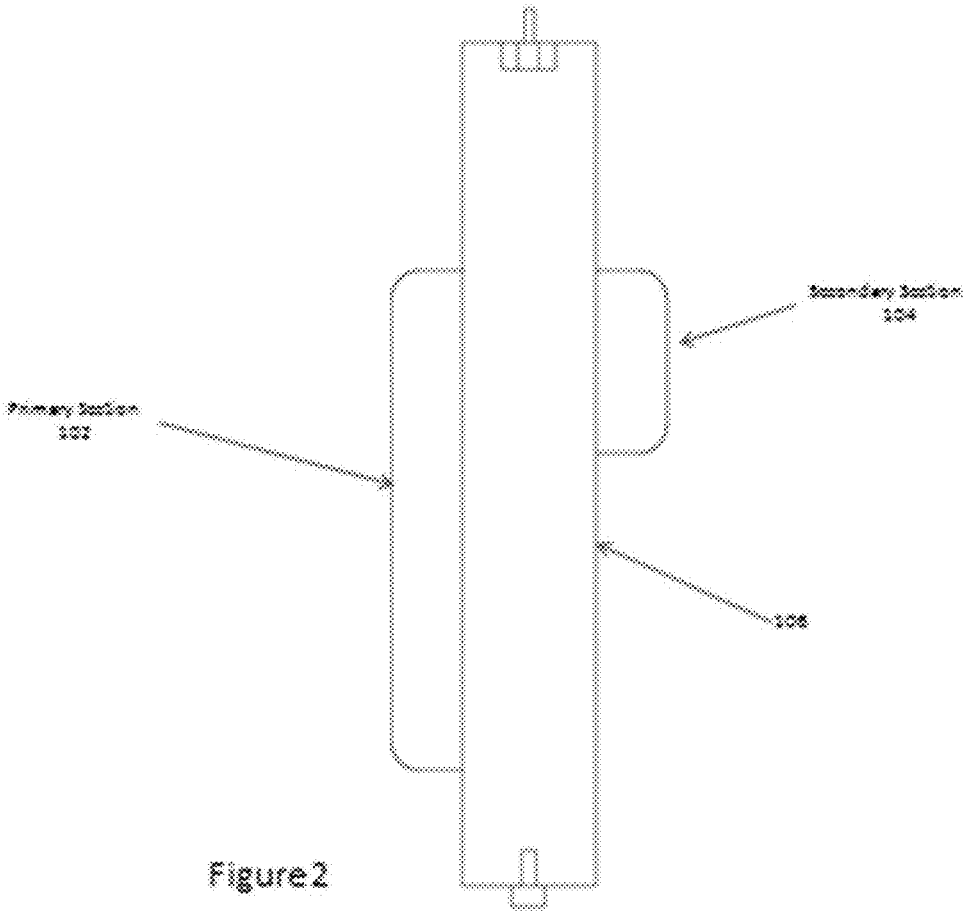
FIG. 2 shows an overhead view of a trigger lock attached to a firearm.

With reference to FIG. 2 the trigger lock is shown in the locked state from an overhead view facing downward towards the top of the slide of firearm 106. Primary section 102 has been inserted through the trigger guard of firearm 106 and mated with secondary section 104. To secure the trigger lock to the firearm, primary section 102 may be rotated 90 degrees to lock into the grooves of grooved cavity 114. Although the present embodiment depicts primary section 102 being rotated into a locked position such that primary section 102 is oriented parallel to the slide of firearm 106, in alternative embodiments primary section may be locked into a different orientation. Such alternate orientations may include where primary section 102 is rotated into a locked position such that primary section 102 is oriented parallel to the grip of firearm 106. In the present embodiment, a locking bolt is used to secure primary section 102 to secondary section 104 but other securing mechanisms are possible in alternative embodiments. For instance, there may be a clamshell type securing mechanism which when activated closes over the trigger guard of firearm 106 preventing access to the trigger. Also, the clamshell mechanism may have teeth which extend into the trigger guard which prevent movement of the trigger while the clamshell mechanism is secured.

Figure 3:
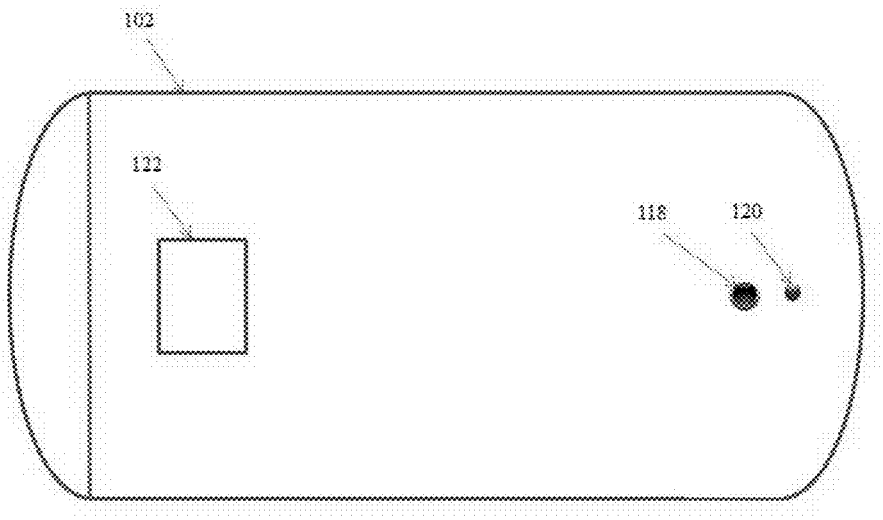
FIG. 3 shows a side elevation view of a trigger lock.

With reference to FIG. 3 a side elevation view of the trigger lock is depicted. The user may interact with components located on primary section 102 such as button 118, for providing user input, and user interface 120, for providing output to the user. In some embodiments, button 118 may be recessed so that the user may locate and activate button 118 using their sense of touch only. Recessed button 118 permits a user to unlock a firearm in the dark or while maintaining visual focus in another direction. User interface 120 may be an LED and provide a range of visual feedback to the user by flashing unique patterns. Alternatively, user interface 120 may be a display, a vibrator or any other device to communicate with a user. Communication interface 122 may be provided for sending and receiving signals including RFID interrogation signals. Communication interface 122 may house communication equipment for transmitting and receiving electromagnetic signals. Where the body of primary section 102 is metallic in some embodiments, communication interface 122 may include a durable, hard plastic covering which provides less attenuation of the signals.

Figure 4:
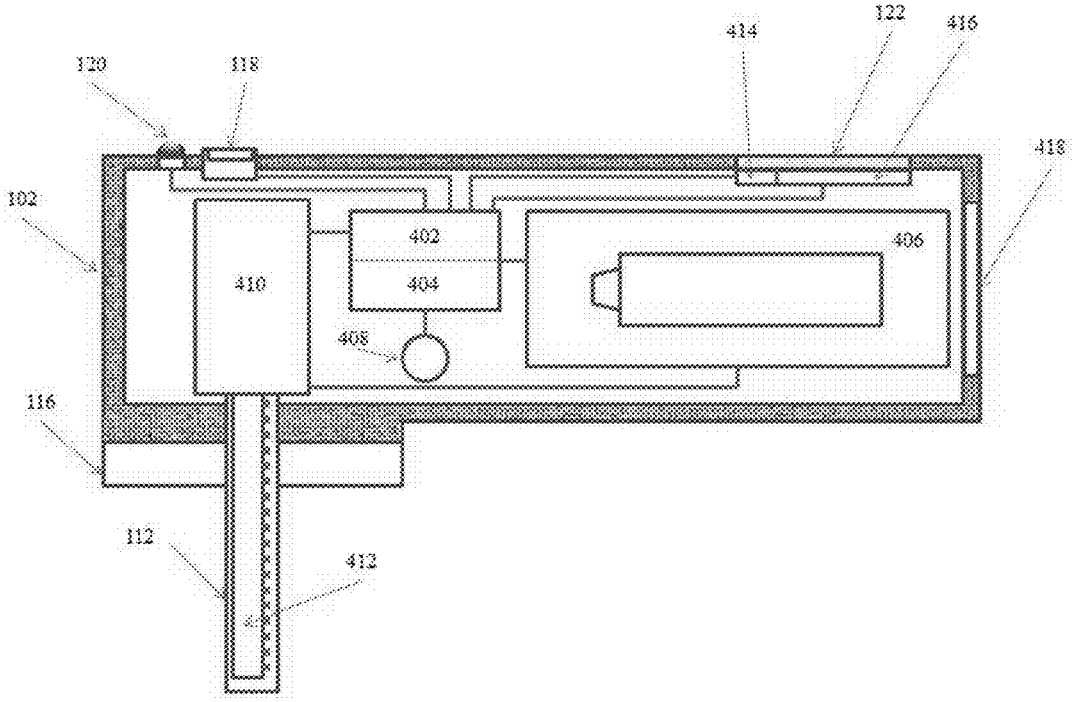
FIG. 4 shows internal hardware components of a trigger lock.

FIG. 4 depicts the internal hardware components of the trigger lock disposed in primary section 102. The trigger lock may comprise microprocessor 402, database 404, main battery 406, backup battery 408, servo motor 410, locking bolt 412, transceiver 414 for a wireless personal network, e.g., Bluetooth®, RF transceiver 416, and battery access door 418. The trigger lock may be implemented using microprocessor 402 which processes stored software instructions to perform the functions of the trigger lock described in this specification. Although the present embodiment uses a microprocessor, any computing device capable of processing software instructions may be used in alternative embodiments. Database 404 may be used to store authorized identifiers and may be referenced by microprocessor 402 during identifier authentication. Main battery 406 may provide electrical power to the trigger lock for use in performing the functions of the trigger lock described in this specification including those of button 118 and user interface 120. Backup battery 408 may be provided in some embodiments which provides backup power to database 404 to prevent erasure of authorized identifiers in the event that main battery 406 is exhausted. Alternatively, database 404 may be stored in a non-volatile memory, eliminating the need for backup power. In the present embodiment, servo motor 410 may be provided to rotate locking bolt 412 to enable locking and unlocking of the trigger lock. In the present embodiment, locking bolt 412 may be disposed within locking bolt housing 112. As described above, other locking mechanisms may be provided in alternative embodiments. Communication interface 122 may include Bluetooth® transceiver 414 and RF transceiver 416. RF transceiver 416 may be used to perform RF interrogation on nearby access keys 124. In some embodiments, Bluetooth® transceiver 414 may be provided to communicate area unlock signals as will be described in greater detail below. Although the present embodiment employs transceivers, other means of communicating electromagnetic signals, such as transmitter/receiver pairs may be used in alternative embodiments. Battery access door 418 may be used to insert and remove main battery 406 and may positioned to allow access in both locked and unlocked states.

Figure 5:
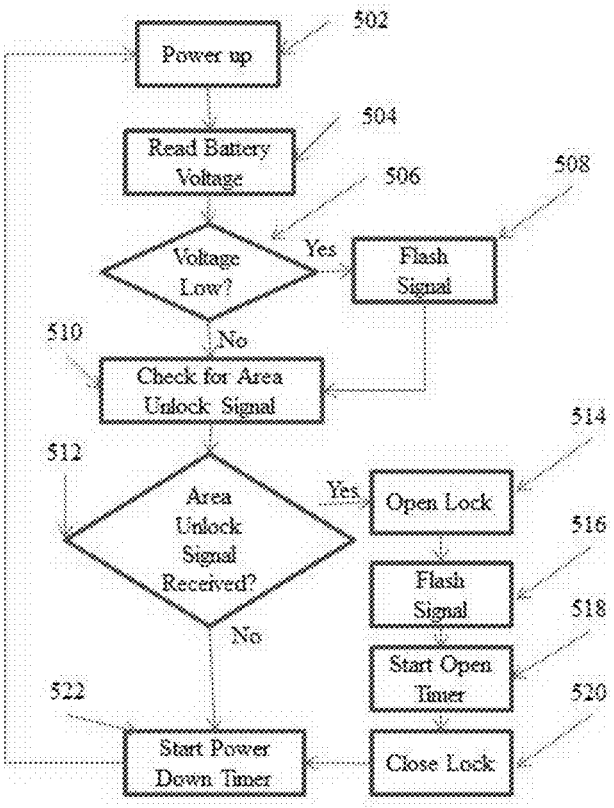
FIG. 5 shows a process for periodically waking a trigger lock processor to check battery voltage and receive signals.

With reference to FIGS. 4 and 5 a periodic wake-up process is depicted. In order to conserve battery life, microprocessor 402 may enter a low-power hibernation mode while the trigger guard is not being operated. However, microprocessor 402 may wake-up periodically to check the voltage of main battery 406 and to detect whether any area unlock signals are present. The concept of area unlock signals will be discussed further below. The periodic wake-up process may begin when a "power down" timer expires and microprocessor 402 powers up at block 502. Microprocessor 402 may then read the voltage of main battery 406 at block 504. It may be determined whether the voltage of main battery 406 is below a threshold at block 506. If the voltage of main battery 406 is below the threshold, microprocessor 402 may instruct user interface 120 to flash, display or otherwise indicate a "low battery" signal at block 508. Microprocessor 402 may then check for an area unlock signal at block 510. It may be determined whether an area unlock signal has been received at block 512. If an area unlock signal has been received at block 512, microprocessor 402 may instruct servo motor 410 to unlock the trigger lock at block 514, instruct user interface 120 to flash, display or otherwise indicate an "unlocked" signal at block 516, and initiate an "open lock" timer at block 518. At the expiration of the "open lock" timer, microprocessor 402 may instruct servo motor 410 to re-lock the trigger lock at block 520. The "open lock" timer may provide a window during which the user can disassemble the trigger lock and remove it from the firearm. If the user fails to remove the trigger lock from the firearm during the window, the trigger lock may re-lock to prevent unauthorized access to the firearm trigger. If at block 512 it is determined that an area unlock signal has not been received, or if the trigger lock is re-locked at block 520, microprocessor 402 may start the "power down" timer and re-enter the low-power hibernation mode at block 522. As an alternative to the "power down" timer described above with regard to block 502, the arrival of area unlock signal may trigger exit of the low power state. Although the present embodiment depicts performing the read voltage and voltage determination at blocks 504 and 506 respectively, prior to performing area unlock signal check and determination at blocks 510 and 512 respectively, this process may be performed in a different order or simultaneously in alternate embodiments. Similarly, although the present embodiment depicts blocks 514, 516, and 518 occurring in a particular order, this process may be performed in a different order or simultaneously in alternate embodiments.

Figure 6:
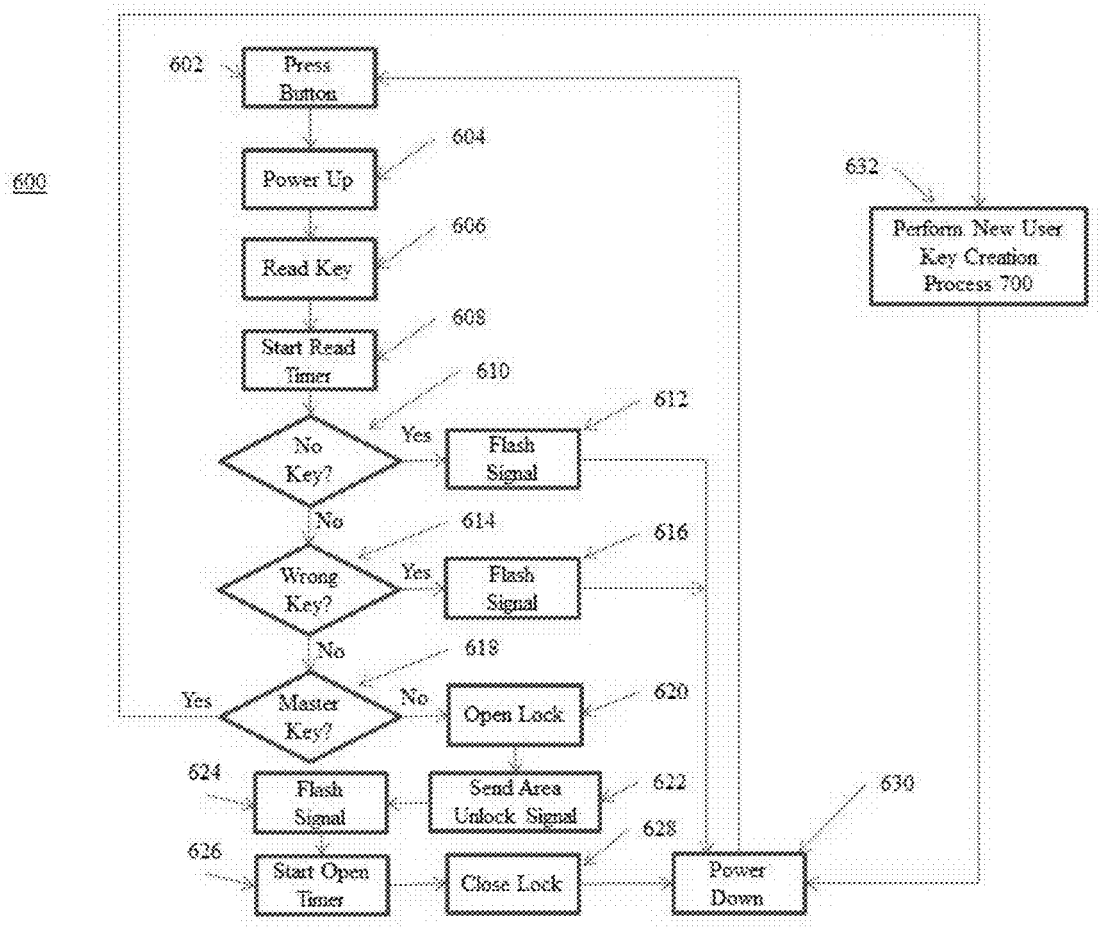
FIG. 6 shows a process for reading nearby user keys.

With reference to FIGS. 4 and 6 a key read process 600 is depicted. Key read process 600 may begin when the user presses button 118 in block 602. Next, microprocessor 402 may power up from a low-power hibernation mode in block 604. Microprocessor 402 may then perform an RF interrogation process to read any nearby access keys 124 in block 606 and start a "read" timer in block 608. Microprocessor 402 may determine whether an access key 124 is read during the window provided by the "read" timer at block 610. If the "read" timer expires without an access key 124 being read, microprocessor 402 may instruct user interface 120 to flash, display or otherwise indicate a "no key" signal at block 612 and re-enter the low-power hibernation mode at block 630. Alternatively, if it is determined at block 610 that an access key 124 is read during the window provided by the "read" timer, microprocessor 402 may determine whether RFID 126 provided by access key 124 is invalid at block 614. If microprocessor 402 determines that RFID 126 is invalid at block 614, microprocessor 402 may instruct user interface 120 to flash, display or otherwise indicate a "bad key" signal at block 616 and re-enter the low-power hibernation mode at block 630. Alternatively, if it determined at block 614 that RFID 126 is not invalid, microprocessor 402 may determine whether valid RFID 126 is a master key in block 618. As discussed in more detail below, a master key may be a type of access key 124 which permits a user to program microprocessor 402 to accept a new access key 124. If microprocessor 402 determines at block 618 that RFID 126 is a master key, microprocessor 402 may then perform a new user key creation process 700 at block 632. Once new user key creation process 700 is completed, microprocessor 402 may re-enter the low-power hibernation mode at block 630. Alternatively, if microprocessor 402 determines at block 618 that RFID 126 is not a master key, microprocessor 402 may instruct servo motor 410 to unlock the trigger lock at block 620, instruct Bluetooth® transceiver 414 to transmit an "area unlock" signal (as will be discussed in further detail below) at block 622, instruct user interface 120 to flash, display or otherwise indicate an "unlocked" signal at block 624, and initiate an "open lock" timer at block 626. At the expiration of the "open lock" timer, microprocessor 402 may instruct servo motor 410 to re-lock the trigger lock at block 628. The "open lock" timer may provide a window during which the user can disassemble the trigger lock and remove it from the firearm. If the user fails to remove the trigger lock from the firearm during the window, the trigger lock may re-lock to prevent unauthorized access to the firearm trigger. If the trigger lock is re-locked at block 628, microprocessor 402 may re-enter the low-power hibernation mode at block 630. Although the present embodiment depicts performing read access keys at block 606 prior to performing the start "read" timer block 608, this process may be performed in a different order or simultaneously in alternate embodiments. Similarly, although the present embodiment depicts blocks 620, 622, 624, and 626 occurring in a particular order, this process may be performed in a different order or simultaneously in alternate embodiments. Further, although the present embodiment provides a particular process for detecting an RFID identifier and distinguishing between unauthorized, authorized, and master key identifiers, this process may be performed using a different order in alternative embodiments.

Figure 7:
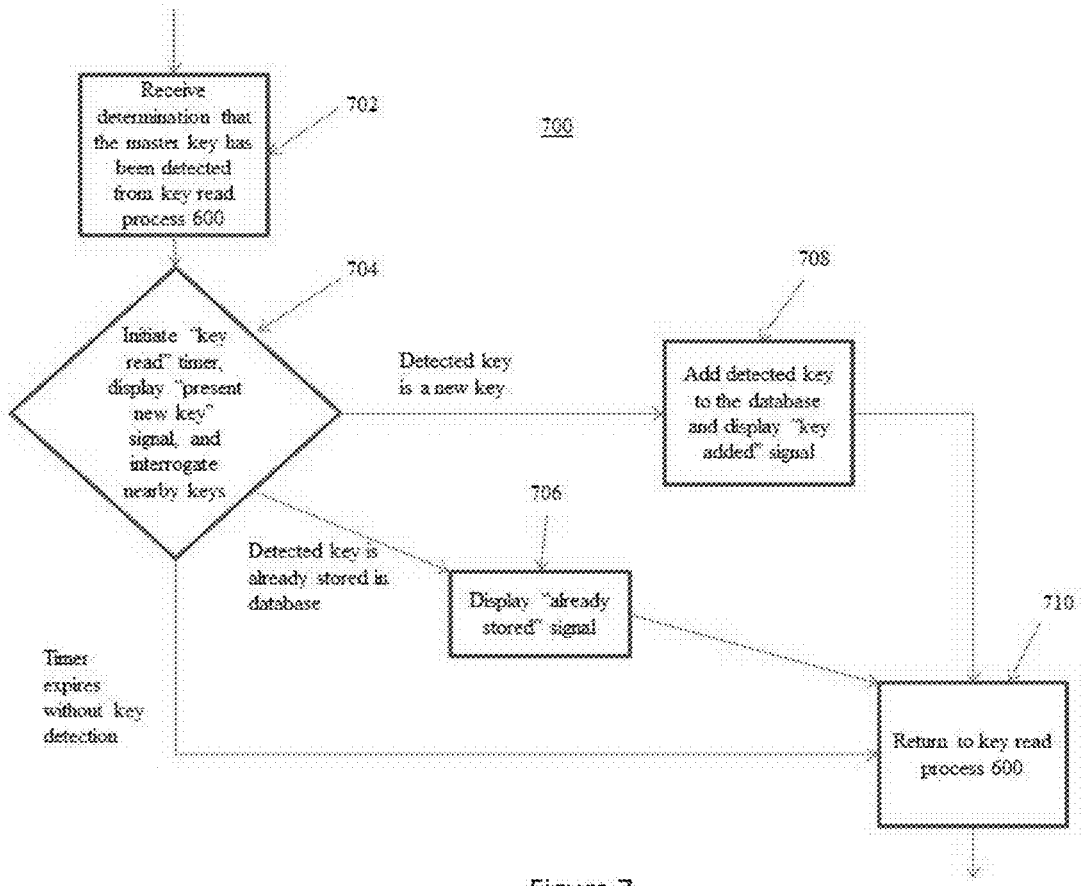
FIG. 7 shows a process for programming a trigger lock to accept a new user key.

With reference to FIGS. 4 and 7 new user key creation process 700 is depicted. Using process 700, a user may add a new access key 124 with a new unique identifier stored in RFID 126 to the list of authorized access keys stored in database 404. To facilitate this function, the user may be provided with a unique master key. The unique function of the master key may be to initiate process 700 when the master key is presented as access key 124 during key read process 600. Process 700 may be initiated upon a determination that the master key has been detected from key read process 600 at block 702. Once process 700 is initiated at block 702, microprocessor 402 may initiate a "key read" timer, instruct user interface 120 to display or indicate a "present new key" signal, and interrogate nearby keys at block 704. In response to the "present new key" signal, the user may position the new access key 124 within proximity to communication component 122. If the "key read" timer expires without an access key 124 detected by microprocessor 402, process 700 may end and microprocessor 402 may return to key read process 600 at block 710. If an access key 124 is detected at block 704 but the RFID 126 identifier is already stored in database 404, microprocessor 402 may instruct user interface 120 to display or indicate an "already stored" signal at block 706. Next, process 700 may end and microprocessor 402 may return to key read process 600 at block 710. If an access key 124 is detected at block 704 and that access key 124 contains a new RFID 126 identifier, microprocessor 402 may add the RFID 126 identifier to database 404 and instruct user interface 120 to display or indicate a "key added" signal at block 708. Next, process 700 ends and microprocessor 402 may return to key read process 600 at block 710.

Figure 8:
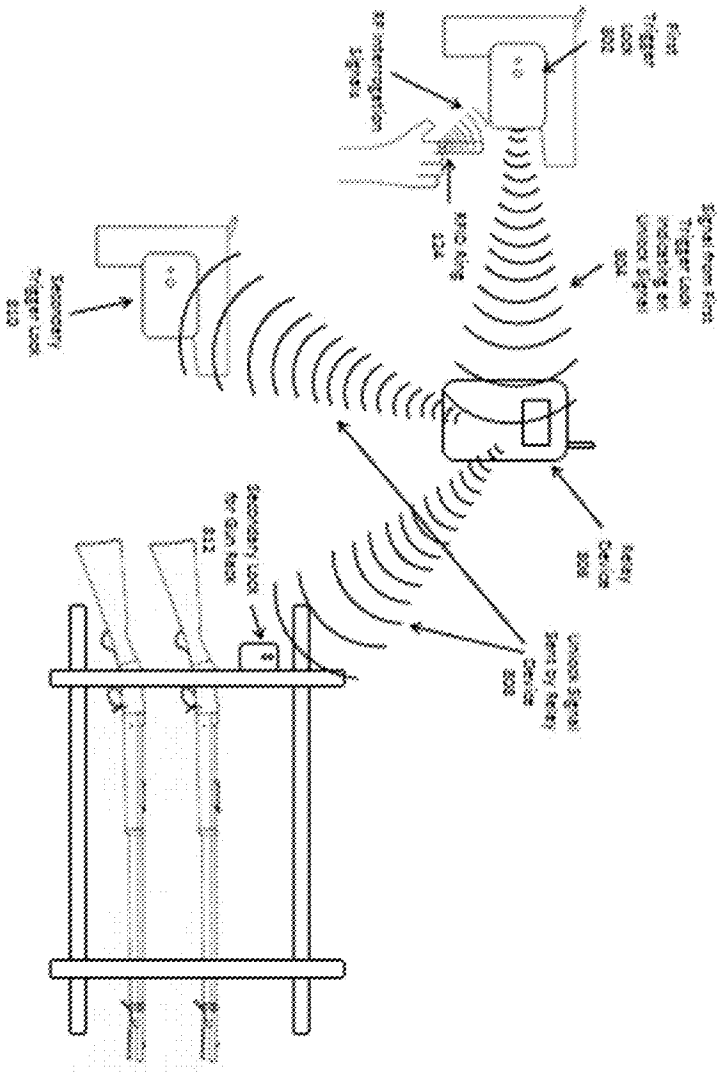
FIG. 8 shows the use of a relay device to unlock several devices using a single authentication check.

With reference to FIG. 8 a process for providing an area unlock signal is depicted. In some embodiments, a user may have the ability to unlock a plurality of nearby trigger locks, or other devices, with a single contact of a first trigger lock. When a user presses button 118 of first trigger lock 802 while positioning a valid access key 124 within proximity of first trigger lock 802, first trigger lock 802 may broadcast an area unlock signal 804 in addition to unlocking first trigger lock 802. In this embodiment, access key 124 takes the form of a ring worn by the user; however, access keys 124 may take other forms as described above. In the present embodiment, area unlock signal 804 sent from first trigger lock 802 may be received by a relay device 806. Relay device 806 may be a cellular telephone in some embodiments; however other devices which can receive and broadcast electromagnetic signals may perform the role of relay device 806 in alternative embodiments. Alternatively, no relay device may be necessary and area unlock signal 804 broadcasted from first trigger lock 802 may independently unlock nearby trigger locks, or other devices. Upon receiving area unlock signal 804, relay device 806 may transmit a relay signal 808 to secondary trigger locks 810 and 812. Relay signal 808 may be identical to area unlock signal 804 in some embodiments or different from area unlock signal 804 in alternative embodiments. Relay signal 808 and area unlock signal 804 may be encrypted to provide additional protection from unauthorized access. In some embodiments, relay device 806 may be activated only by signals from those first trigger locks 802 that relay device 806 has been paired with. Similarly, only those secondary trigger locks 810 and 812 may be activated which have been paired with relay device 806. Upon receiving relay signal 808, secondary trigger locks 810 and 812 unlock. In the present embodiment, secondary trigger locks take the form of trigger lock 810 attached to a single firearm and/or lock 812 attached to a gun rack. Relay signal 808 may be received by one or more secondary trigger locks and each secondary trigger lock may unlock one or more firearms in alternative embodiments. Additionally, relay device 806 may be configured such that a user could initiate the relay signal 808 directly from the device 806, e.g., opening a trigger lock directly from a cellular telephone.

One skilled in the art will appreciate that the present invention can be practiced by other than the described embodiments, which are presented for purposes of illustration and not limitation, and the present invention is limited only by the claims that follow.

What is claimed is:

1. A method, comprising:

detecting user activation of a button disposed on a trigger lock;

communicating with a token located within a proximity of the trigger lock in response to the detection;

receiving a user identifier from the token during the communication;

determining whether the received user identifier is valid; and unlocking the trigger lock if the user identifier is determined to be valid;

where, provided that the token is located within the proximity and is valid, the user is only required to make a single contact with the trigger lock to unlock the trigger lock.

2. The method according to claim 1, wherein the token is a wearable item.

3. The method according to claim 1, wherein the token is a passive RFID tag.

4. The method according to claim 1, wherein the token is one of a plurality of tokens, at least one of the tokens is a master token and upon a determination that the received identifier is a master token, registering a new valid token for the trigger lock.

5. The method according to claim 4, wherein each of the plurality of tokens stores a unique identifier.

6. The method according to claim 1, further comprising causing a user interface to provide visual output to the user, and where the user interface is disposed in a location on the trigger lock such that user activation of the button does not block the user's view of the user interface.

7. The method according to claim 1, further comprising re-locking the trigger lock if the user does not remove the trigger lock from a firearm within a predetermined period of time after the trigger lock is unlocked.

8. The method according to claim 1, further comprising operating the trigger lock in a low-power standby mode while inactive.

9. The method according to claim 1, wherein the unlocking of the trigger lock further comprises transmitting an area unlock signal, wherein the transmitting causes any secondary lock receiving the unlock signal to unlock, where the single secondary lock may unlock a plurality of firearms.

10. The method according to claim 9, further comprising sending the area unlock signal to a relay device, and the relay device transmitting a relay signal in response to receiving the area unlock signal, wherein the transmitting causes any secondary lock receiving the relay signal to unlock.

11. The method according to claim 10, wherein the relay device is a cellular telephone.

12. The method according to claim 10, wherein the area unlock signal is an encrypted radio signal.

13. The method according to claim 10, wherein provided that the token is located within the proximity and is determined to be valid, the user is only required to make a single contact with the trigger loch to unlock both the trigger lock, and any secondary lock receiving at least one of the area unlock signal and the relay signal.

14. The method according to claim 10, further comprising operating the trigger lock and any secondary lock in a low-power standby mode while inactive, and while in the low-power standby mode, waking a corresponding one of the trigger lock and any secondary lock periodically to detect whether an area unlock signal has been transmitted.

15. The method according to claim 14, further comprising checking by the corresponding one of the trigger lock or any secondary lock during the periodic wake-up, the remaining power of a battery disposed within the corresponding one of the trigger lock or the secondary lock and if the remaining power is below a threshold, outputting by the corresponding one of the trigger lock or the secondary lock a low battery signal.

16. An apparatus, comprising:

a trigger lock, comprising:

a button;

a communication interface; and a processor;

where the processor is configured to:

detect user activation of the button;

in response to the detection, communicate, using the communication interface, with a token located within a proximity to the trigger lock;

receive a user identifier from the token during the communication through the communication interface;

determine whether the received user identifier is valid; and unlock the trigger lock if the user identifier is determined to be valid;

where, provided that the token is located within the proximity and is valid, the user is only required to make a single contact with the trigger lock to unlock the trigger lock.

17. The apparatus according to claim 16, wherein the token is a wearable item.

18. The apparatus according to claim 16, wherein the token is a passive RFID tag.

19. The apparatus according to claim 16, further comprising a plurality of tokens, each of the tokens storing a unique identifier.

20. The apparatus according to claim 19, wherein at least one of the tokens is a master token and where, upon a determination that the received identifier is a master token, the user is able to register a new valid token with the processor.

21. The apparatus according to claim 16, wherein the trigger lock includes at least one user interface to provide visual output to the user, and where the at least one user interface is disposed in a location on the trigger lock such that user activation of the button does not block the user's view of the at least one user interface.

22. The apparatus according to claim 16, where the processor re-locks the trigger lock if the user does not remove the trigger lock from a firearm within a predetermined period of time after the trigger guard is unlocked.

23. The apparatus according to claim 16, wherein the processor operates in a low-power standby mode while not interacting with a user.

24. The apparatus according to claim 16, further comprising at least one secondary lock, wherein the processor also causes an area unlock signal to be transmitted using the communication interface, and where the transmission of the area unlock signal causes any secondary lock receiving the area unlock signal to unlock, where the secondary lock may unlock a plurality of firearms.

25. The apparatus according to claim 24, further comprising a relay device which receives the area unlock signal from the trigger lock and transmits a relay signal in response to receiving the area unlock signal, wherein any secondary lock receiving the relay signal unlocks.

26. The apparatus according to claim 25, wherein the relay device is a cellular telephone.

27. The apparatus according to claim 25, wherein the area unlock signal is an encrypted radio signal.

28. The apparatus according to claim 25, wherein provided that the token is located within the proximity and is valid, the user is only required to make a single contact with the trigger lock to unlock both the trigger lock, and any secondary lock receiving at least one of the area unlock signal and the relay signal.

29. The apparatus according to claim 25, wherein the at least one secondary lock includes a processor, and wherein the processor of the trigger lock and the processor of the at least one secondary lock both operate in a low-power standby mode white inactive; and while in the low-power standby mode, each of the processors wakes-up periodically to detect whether an area unlock signal has been transmitted.

30. The apparatus according to claim 29, wherein, during the periodic wake-up, each of the processors checks the remaining power of a battery disposed within a corresponding one of the trigger lock or the at least one secondary lock and if the remaining power is below a threshold, outputs a low battery signal.

* * * * *